US011237586B2

(12) United States Patent
Chen

(10) Patent No.: US 11,237,586 B2
(45) Date of Patent: Feb. 1, 2022

(54) REFERENCE VOLTAGE GENERATING CIRCUIT

(71) Applicant: REALTEK SEMICONDUCTOR CORPORATION, Hsinchu (TW)

(72) Inventor: Leaf Chen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/890,078

(22) Filed: Jun. 2, 2020

(65) Prior Publication Data

US 2020/0387186 A1 Dec. 10, 2020

(30) Foreign Application Priority Data

Jun. 4, 2019 (TW) ..... 108119375

(51) Int. Cl.
*G05F 3/26* (2006.01)
*G05F 1/577* (2006.01)
(Continued)

(52) U.S. Cl.
CPC ..... *G05F 3/26* (2013.01); *G05F 1/468* (2013.01); *G05F 1/561* (2013.01); *G05F 1/577* (2013.01); *G05F 3/262* (2013.01)

(58) Field of Classification Search
CPC ..... G05F 3/26; G05F 3/262
(Continued)

(56) References Cited

U.S. PATENT DOCUMENTS 6,570,371 B1 * 5/2003 Volk ..... G05F 3/262 323/315
7,102,342 B2 * 9/2006 Kim ..... G05F 3/262 323/277
(Continued)

FOREIGN PATENT DOCUMENTS

CN 101382812 A 3/2009
TW 201612673 A 4/2016

OTHER PUBLICATIONS

OA letter of the counterpart TW application (appl. No. 108119375) dated Oct. 1, 2019. Summary of the OA letter Claims 1, 5-9 are rejected as being unpatentable over the cited reference 1 (CN 101382812 A, also published as U.S. Pat. No. 7,636,010B2) in view of the cited reference 2 (TW 201612673 A, also published as US20160091916A1).

*Primary Examiner* — Gary A Nash
(74) *Attorney, Agent, or Firm* — WPAT, PC

(57) ABSTRACT

Disclosed is a reference voltage generating circuit including a bandgap reference voltage generating circuit, a voltage controlled current source circuit, a current mirror circuit, an input voltage generating circuit, and a voltage controlled voltage source circuit. The bandgap reference voltage generating circuit generates a bandgap reference voltage. The voltage controlled current source circuit generates a reference current according to the bandgap reference voltage. The current mirror circuit generates a mirrored current according to the reference current. The input voltage generating circuit determines an input voltage according to the mirrored current. The voltage controlled voltage source circuit generates a reference voltage according to the input voltage. Accordingly, the reference voltage is generated with voltage-to-current conversion and voltage-to-voltage conversion so that the mirrored current can be accurate without
(Continued)

being affected by the reference voltage and the reference voltage itself can be accurate.

20 Claims, 5 Drawing Sheets

(51) Int. Cl.
*G05F 1/56* (2006.01)
*G05F 1/46* (2006.01)

(58) Field of Classification Search
USPC ..... 323/312–317
See application file for complete search history.

(56) References Cited

U.S. PATENT DOCUMENTS

| | | | | |
|---|---|---|---|---|
| 7,636,010 | B2 | 12/2009 | Huang | |
| 2002/0135424 | A1* | 9/2002 | Oikawa | G05F 3/262 330/288 |
| 2012/0001613 | A1* | 1/2012 | Larsen | G05F 3/262 323/315 |
| 2013/0271095 | A1* | 10/2013 | Jackum | G05F 1/56 323/270 |
| 2014/0145702 | A1* | 5/2014 | Wu | G05F 1/561 323/315 |
| 2016/0062376 | A1* | 3/2016 | Kim | G05F 1/575 323/280 |
| 2016/0091916 | A1 | 3/2016 | Chang et al. | |

* cited by examiner

REFERENCE VOLTAGE GENERATING CIRCUIT

BACKGROUND OF THE INVENTION

1. Field of the Invention

The present invention relates to a voltage generator, especially to a reference voltage generating circuit.

2. Description of Related Art

Accurate reference voltages are required in certain types of circuit. A conventional reference voltage generating circuit generates a reference voltage using the following steps: dividing a bandgap reference voltage that is generated by a bandgap voltage generator and that is insensitive to temperature by the resistance of a stable resistor, in order to obtain a reference current which is inversely proportional to the temperature coefficient of the stable resistor; using a current mirror to generate a mirrored current according to the reference current; and letting the mirrored current (inversely proportional to the temperature coefficient) pass through a reference resistor identical to the stable resistor (having resistance proportional to the temperature coefficient) to obtain a reference voltage unrelated to the temperature coefficient of the reference resistor. These conventional steps not only prevents the problem of deviation caused by the difference between the grounding voltages of different circuits (e.g., the grounding voltage of a ground terminal coupled to the stable resistor and the grounding voltage of another ground terminal coupled to the reference resistor), but also provides the reference voltage that is not associated with the temperature coefficient of the reference resistor.

However, the aforementioned reference voltage generating circuit may have the following problem: if the reference voltage generated according to the mirrored current and the resistance of the reference resistor is excessively high, this high reference voltage can affect the drain-to-source voltage $|V_{DS}|$ of the MOSFET via which the mirrored current flows, thereby affecting the operating point of the MOSFET, causing the mirrored current to be inaccurate, and lowering the accuracy of the reference voltage.

SUMMARY OF THE INVENTION

An object of the present disclosure is to disclose a reference voltage generating circuit as an improvement over the prior art.

An embodiment of the reference voltage generating circuit of the present disclosure includes a bandgap reference voltage generating circuit, a voltage controlled current source circuit, a current mirror circuit, an input voltage generating circuit, and a voltage controlled voltage source circuit. The bandgap reference voltage generating circuit is configured to generate a bandgap reference voltage. The voltage controlled current source circuit is configured to generate a reference current according to the bandgap reference voltage. The current mirror circuit is configured to generate a mirrored current according to the reference current. The input voltage generating circuit is configured to determine an input voltage according to the mirrored current. The voltage controlled voltage source circuit is configured to generate a reference voltage according to the input voltage. Accordingly, the reference voltage is generated with voltage-to-current conversion and voltage-to-voltage conversion so that the mirrored current can be accurate without being affected by the reference voltage and the reference voltage itself can be accurate.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

The present disclosure discloses a reference voltage generating circuit. The reference voltage generating circuit can prevent its generated reference voltage from affecting its own operating region and thereby ensures the accuracy of the reference voltage.

Figure 1:
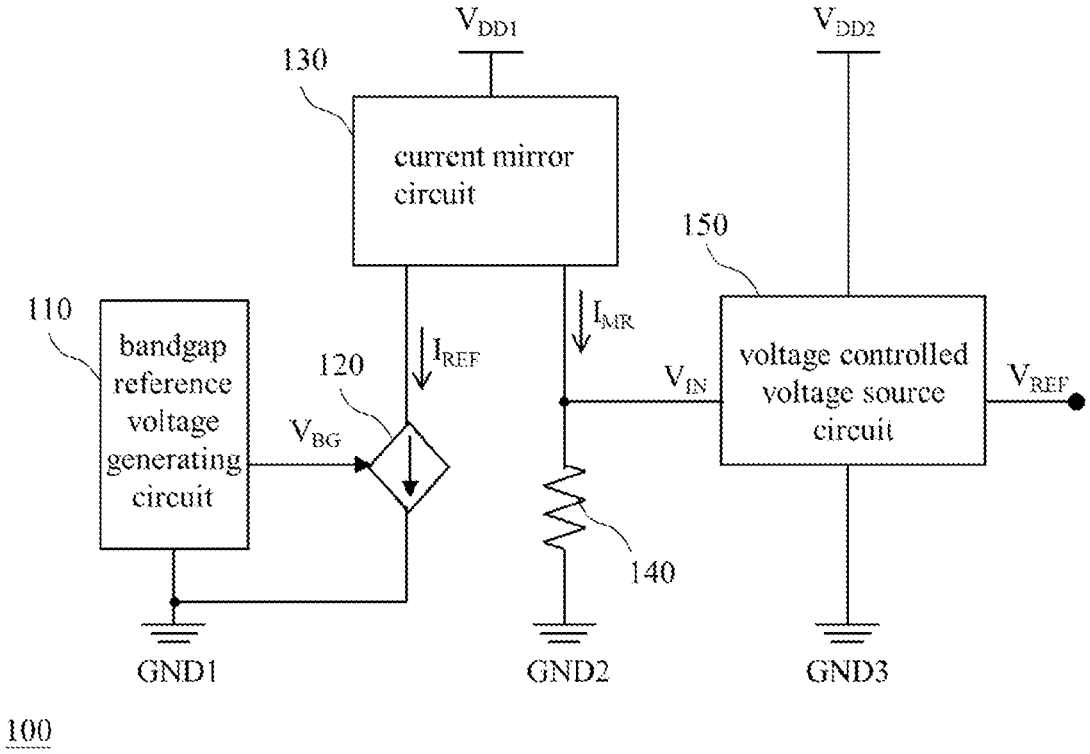
FIG. 1 shows an embodiment of the reference voltage generating circuit of the present disclosure.

FIG. 1 shows an embodiment of the reference voltage generating circuit of the present disclosure. The reference voltage generating circuit 100 of FIG. 1 includes a bandgap reference voltage generating circuit 110, a voltage controlled current source circuit (VCIS) 120, a current mirror circuit 130, an input voltage generating circuit 140, and a voltage controlled voltage source circuit (VCVS) 150.

Please refer to FIG. 1. The bandgap reference voltage generating circuit 110 is coupled between the VCIS 120 and a first ground terminal GND1 and configured to output a bandgap reference voltage $V_{BG}$ to the VCIS 120. Since the bandgap reference voltage generating circuit 110 can be a known or self-developed circuit, its detail is omitted here. The VICS 120 is coupled between the current mirror circuit 130 and the first ground terminal GND1 and configured to generate a reference current $I_{REF}$ according to the bandgap reference voltage $V_{BG}$. Since the VCIS 120 can be a known or self-developed circuit (e.g., a circuit dividing the bandgap voltage $V_{BG}$ by the resistance of a stable resistor), its detail is omitted here. The current mirror circuit 130 is coupled between a first operating voltage terminal $V_{DD1}$ (e.g., a power supply terminal) and the VCIS 120, and also coupled between the first operating voltage terminal $V_{DD1}$ and the input voltage generating circuit 140. The current mirror circuit 130 is configured to generate a mirrored current $I_{MR}$ according to the reference current $I_{REF}$; an embodiment of the current mirror circuit 130 is explained in a later paragraph. The input voltage generating circuit 140 is coupled between the current mirror circuit 130 and a second ground terminal GND2 and configured to determine an input voltage according to the mirrored current $I_{MR}$; in this embodiment, the input voltage generating circuit 140 is a resistor and the input voltage is equal to or approximates the mirrored current $I_{MB}$ times the resistance of the input voltage generating circuit 140, wherein the input voltage generating circuit 140 can be a stable resistor or an adjustable resistor used to make the drain-to-source voltages $V_{DS}$ of at least two transistors of the current mirror circuit 130 be equal or similar. It should be noted that the input voltage generating circuit 140 can be a circuit other than a resistor as long as such implementation is practicable. The VCVS 150 is coupled between a second operating voltage terminal $V_{DD2}$ (e.g., a power supply terminal) and a third ground terminal GND3 and configured to generate a reference voltage $V_{REF}$ according to the input voltage $V_{IN}$; an embodiment of the VCVS 150 is explained in a later paragraph. It should be noted that the voltages of the aforementioned first operating voltage terminal $V_{DD1}$ and second operating voltage terminal $V_{DD2}$ can be equal or unequal, and the grounding voltages of any two of the first ground terminal GND1, second ground terminal GND2, and third ground terminal GND3 can be equal or unequal.

Please refer to FIG. 1. In an exemplary implementation, the whole reference voltage generating circuit 100 is within a first power domain, the voltages of the first operating voltage terminal $V_{DD1}$ and the second operating voltage terminal $V_{DD2}$ are equal, and the voltages of any two of the ground terminals GND1, GND2, and GND3 are equal or unequal. In another exemplary implementation, the bandgap reference voltage generating circuit 110, the VCIS 120, the current mirror circuit 130, and the input voltage generating circuit 140 are within a first power domain while the VCVS 150 is within a second power domain; accordingly, in comparison with the reference voltage of the prior art that is limited to the maximum operating voltage of the power domain where the current mirror circuit 130 is set, the reference voltage $V_{REF}$ generated by the VCVS 150 of the present exemplary implementation is freed from the maximum operating voltage of the first power domain. For instance, the voltage of the first operating voltage terminal $V_{DD1}$ is the maximum operating voltage (e.g., 2.5V) of the first power domain; the voltage of the second operating voltage terminal $V_{DD2}$ is the maximum operating voltage (e.g., 3.3V) of the second power domain; the voltage of the first operating voltage terminal $V_{DD1}$ is lower than the voltage of the second operating voltage terminal $V_{DD2}$ and thus the reference voltage $V_{REF}$, that is limited to the voltage of the second operating voltage terminal $V_{DD2}$, can be higher than the voltage of the first operating voltage terminal $V_{DD1}$ (e.g., $2.5V<V_{REF}\leq 3.3V$); by means of multiple power domains, the reference voltage generating circuit 100 can generate a higher reference voltage in accordance with the demand for implementation. It should be noted that the minimum operating voltage of the first power domain (e.g., the grounding voltage of the ground terminal GND1 or GND2) can be equal or unequal to the minimum operating voltage of the second power domain (e.g., the voltage of the ground terminal GND3).

Figure 2:
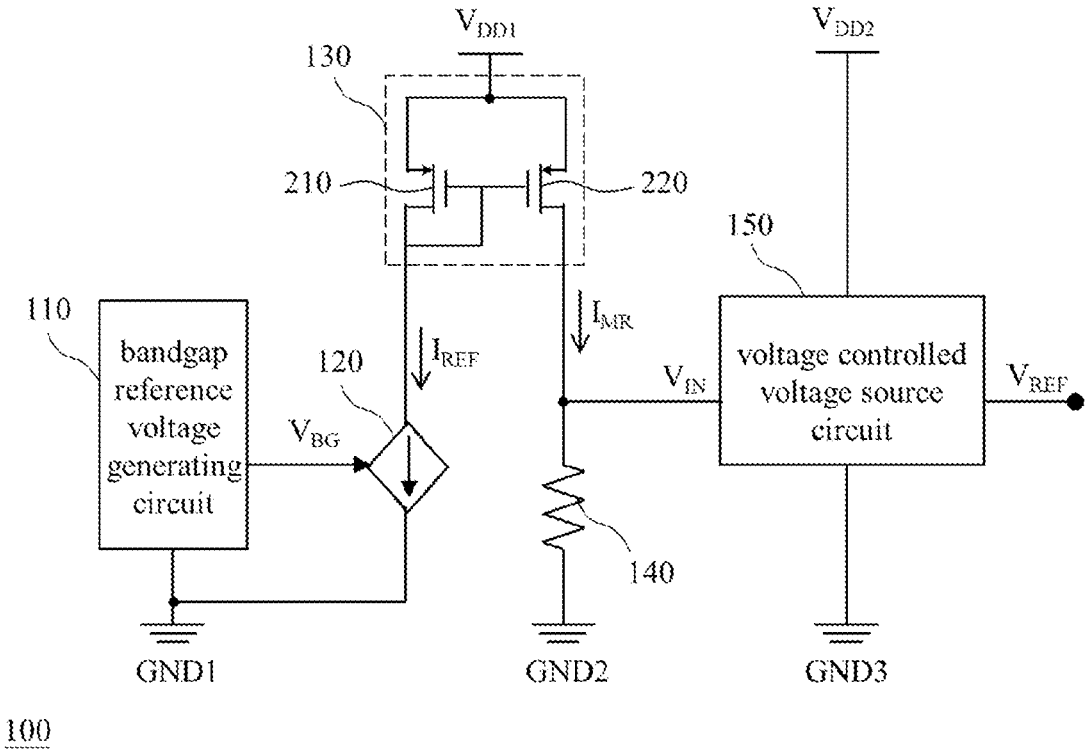
FIG. 2 shows an embodiment of the current mirror circuit of FIG. 1.

FIG. 2 shows an embodiment of the current mirror circuit 130 of FIG. 1. As shown in FIG. 2, the current mirror circuit 130 includes a first PMOS transistor 210 and a second PMOS transistor 220. The first PMOS transistor 210 is coupled between the first operating voltage terminal $V_{DD1}$ and the VCIS 120. The second PMOS transistor 220 is coupled between the first operating voltage terminal $V_{DD1}$ and the input voltage generating circuit 140. The gate terminal of the first PMOS transistor 210, the gate germinal of the second PMOS transistor 220, and the drain terminal of the first PMOS transistor 210 are coupled together. In a circumstance that the resistance of the input voltage generating circuit 140 is properly determined, the drain-to-source voltage $V_{DS1}$ of the first PMOS transistor 210 is equal to or similar to the drain-to-source voltage $V_{DS2}$ of the second PMOS transistor 220 so that the reference current $I_{REF}$ is proportional to the mirrored current $I_{MR}$ based on the ratio of the size of the first PMOS transistor 210 to the size of the second PMOS transistor 220; for instance, if the ratio is one, the reference current $I_{REF}$ will be equal to the mirrored current $I_{MR}$. Consequently, the input voltage $V_{IN}$ and the reference voltage $V_{REF}$ can be accurate as required. It should be noted that the current mirror circuit 130 can be realized with NMOS transistors; since those of ordinary skill in the art can appreciate how to modify the configuration of the reference voltage generating circuit 100 in this circumstance by referring to the present disclosure, repeated and redundant description is omitted here. It should also be noted that other kinds of current mirror can be used as the current mirror circuit 130 if it is practicable.

Figure 3:
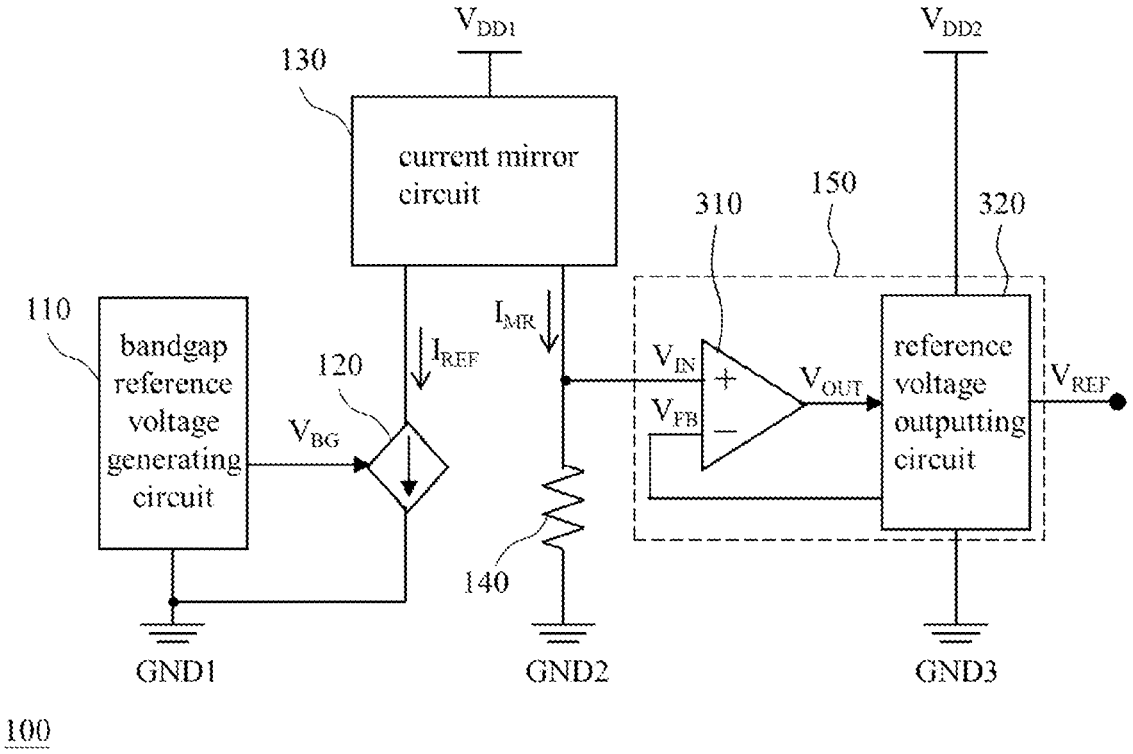
FIG. 3 shows an embodiment of the voltage controlled voltage source circuit of FIG. 1.

FIG. 3 shows an embodiment of the VCVS 150 of FIG. 1. As shown in FIG. 3, the VCVS 150 includes an amplifier (e.g., an error amplifier) 310 and a reference voltage outputting circuit 320. The amplifier 310 includes a positive input terminal, a negative input terminal, and an output terminal. The positive input terminal is configured to receive the input voltage $V_{IN}$; the negative input terminal is configured to receive a feedback voltage $V_{FB}$; and the output terminal is configured to output an output voltage \$T_{our}$. The reference voltage outputting circuit 320 is configured to generate the reference voltage $V_{REF}$ and the feedback voltage $V_{FB}$ according to the output voltage $V_{DDT}$ and a feedback ratio (3, wherein the feedback voltage $V_{FB}$ is equal to or similar to the reference voltage $V_{REF}$ multiplied by the feedback ratio β (i.e., $V_{FB}=V_{REF}\times\beta$ or $V_{FB}\approx V_{REF}\times\beta$). More specifically, the feedback voltage $V_{FB}$ gets close to the input voltage $V_{IN}$ due to the virtual ground characteristic of the amplifier 310. Therefore, in a circumstance that the input voltage $V_{IN}$ is fixed, the smaller the feedback ratio β, the higher the reference voltage $V_{REF}$; and the greater the feedback ratio β, the lower the reference voltage $V_{REF}$.

Figure 4:
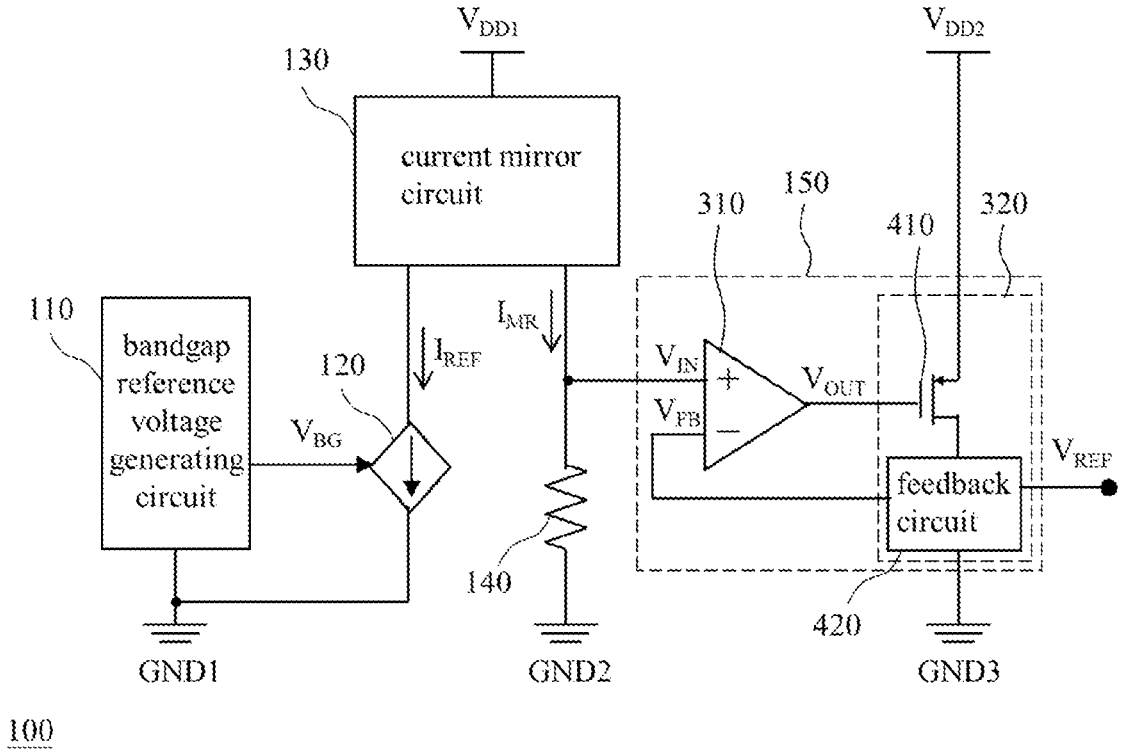
FIG. 4 shows an embodiment of the reference voltage outputting circuit of FIG. 3.
Figure 5:
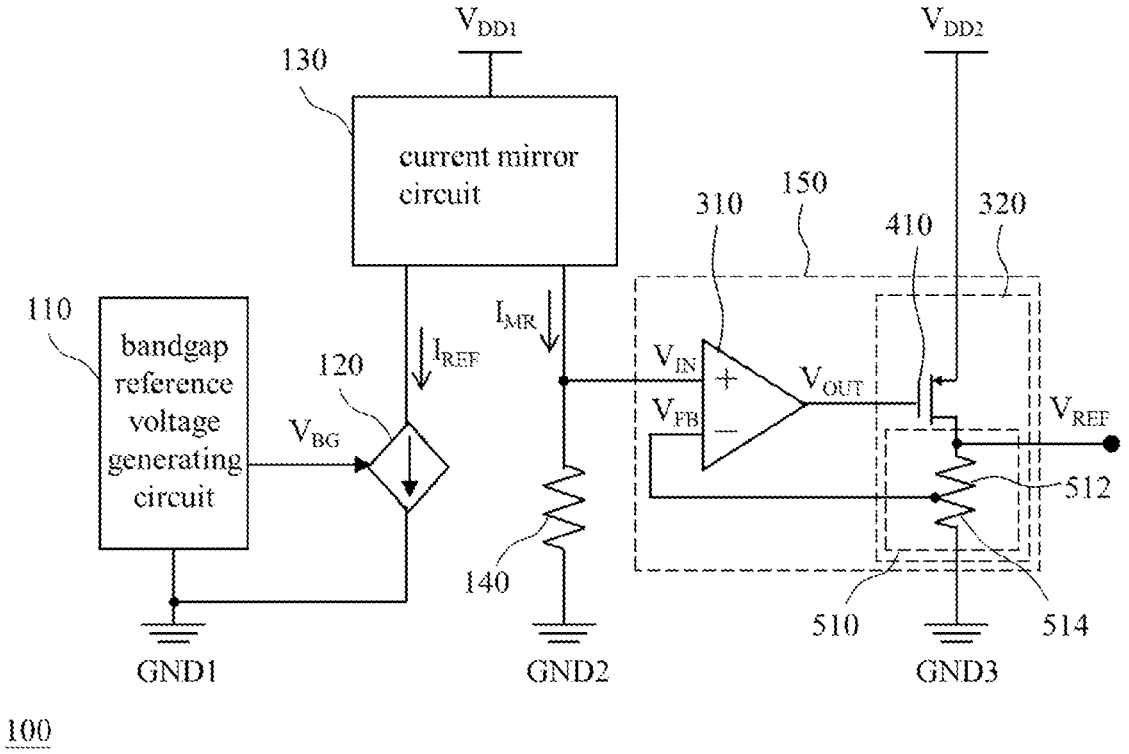
FIG. 5 shows an embodiment of the feedback circuit of FIG. 4.

FIG. 4 shows an embodiment of the reference voltage outputting circuit 320. As shown in FIG. 4, the reference voltage outputting circuit 320 includes an output transistor 410 and a feedback circuit 420. The output transistor 410 is coupled between the aforementioned second operating voltage terminal $V_{DD2}$ and the feedback circuit 420 and configured to be turned on or off according to the output voltage \$T_{our}$. In detail, providing the output transistor 410 is a PMOS transistor, when the input voltage $V_{IN}$ is higher than the feedback voltage $V_{FB}$, the output voltage $V_{DDT}$ is a positive voltage turning off the output transistor 410 and thereby the reference voltage $V_{REF}$ is pulled down due to the electric discharge via the feedback circuit 420; and when the input voltage $V_{IN}$ is lower than the feedback voltage $V_{FB}$, the output voltage $V_{OUT}$ is a negative voltage turning on the transistor 410 and thereby the reference voltage $V_{REF}$ is pulled high due to the connection to the second operation voltage terminal $V_{DD2}$. The feedback circuit 420 is coupled between the output transistor 410 and the aforementioned third ground terminal GND3, and coupled to the negative input terminal of the amplifier 310. The feedback circuit 420 is configured to generate the reference voltage $V_{REF}$ and the feedback voltage $V_{FB}$ according to the conducting status (a.k.a. on/off status) of the output transistor 410 and the feedback ratio. In an exemplary implementation, the feedback circuit 420 is an adjustable resistance circuit including a first resistor and a second resistor (e.g., a first part 512 and second part 514 of the adjustable resistance circuit 510 in FIG. 5) and the ratio of the resistance of the first resistor to the resistance of the second resistor determines the feedback ratio.

It should be noted that other kinds of known or self-developed VCVS can be used as the VCVS 150 of FIG. 1 as long as such replacement is practicable. In addition, people of ordinary skill in the art can implement the present invention by selectively using some or all of the features of any embodiment in this specification or selectively using some or all of the features of multiple embodiments in this specification as long as such implementation is practicable, which implies that the present invention can be carried out flexibly.

To sum up, the reference voltage generating circuit of the present disclosure generates a reference voltage with voltage-to-current conversion and voltage-to-voltage conversion so as to prevent the reference voltage from affecting the operating region of the reference voltage generating circuit itself and thereby make sure the reference voltage would be accurate. Additionally, the reference voltage generating circuit of the present disclosure can operate in multiple power domains and this feature allows the reference voltage generating circuit to generate the reference voltage within a wider range.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A reference voltage generating circuit comprising:

a bandgap reference voltage generating circuit configured to generate a bandgap reference voltage;

a voltage controlled current source circuit configured to generate a reference current according to the bandgap reference voltage;

a current mirror circuit configured to generate a mirrored current according to the reference current;

an input voltage generating circuit configured to determine an input voltage according to the mirrored current; and a voltage controlled voltage source circuit configured to generate a reference voltage according to the input voltage, wherein the bandgap reference voltage generating circuit is not connected to the voltage controlled voltage source circuit and does not receive the reference voltage, and the input voltage generating circuit does not receive the reference current from the voltage controlled current source circuit.

2. The reference voltage generating circuit of claim 1, wherein the bandgap reference voltage generating circuit, the voltage controlled current source circuit, the current mirror circuit, and the input voltage generating circuit are in a first power domain while the voltage controlled voltage source circuit is in a second power domain.

3. The reference voltage generating circuit of claim 2, wherein a maximum operating voltage of the first power domain is lower than a maximum operating voltage of the second power domain.

4. The reference voltage generating circuit of claim 3, wherein the reference voltage is higher than the maximum operating voltage of the first power domain.

5. The reference voltage generating circuit of claim 3, wherein the first power domain and the second power domain include a plurality of ground terminals, and any two grounding voltages of the plurality of ground terminals are equal or unequal.

6. The reference voltage generating circuit of claim 3, wherein one of the first power domain and the second power domain includes a plurality of ground terminals, and any two grounding voltages of the plurality of ground terminals are equal or unequal.

7. The reference voltage generating circuit of claim 2, wherein the current mirror circuit includes a first transistor and a second transistor; the first transistor is coupled between a maximum operating voltage terminal of the first power domain and the voltage controlled current source circuit; the second transistor is coupled between the maximum operating voltage terminal and the input voltage generating circuit; a gate terminal of the first transistor, a gate terminal of the second transistor, and a drain terminal of the first transistor are coupled together; and a voltage of the maximum operating voltage terminal is a maximum operating voltage of the first power domain.

8. The reference voltage generating circuit of claim 7, wherein the voltage controlled current source circuit is coupled between the first transistor and a ground terminal of the first power domain.

9. The reference voltage generating circuit of claim 8, wherein the bandgap reference voltage generating circuit is coupled between the voltage controlled current source circuit and the ground terminal of the first power domain.

10. The reference voltage generating circuit of claim 7, wherein the input voltage generating circuit is coupled between the second transistor and a ground terminal of the first power domain.

11. The reference voltage generating circuit of claim 7, wherein both the first transistor and the second transistor are PMOS transistors, and a drain-to-source voltage of the first transistor is equal to a drain-to-source voltage of the second transistor.

12. The reference voltage generating circuit of claim 2, wherein the voltage controlled voltage source circuit is coupled between a maximum operating voltage terminal of the second power domain and a ground terminal of the second power domain, and a voltage of the maximum operating voltage terminal is a maximum operating voltage of the second power domain.

13. The reference voltage generating circuit of claim 1, wherein resistance of the input voltage generating circuit is adjustable.

14. The reference voltage generating circuit of claim 13, wherein the current mirror circuit includes a first PMOS transistor and a second PMOS transistor, the reference current flows from the first PMOS transistor, the mirrored current flows from the second PMOS transistor, and the first PMOS transistor and the second PMOS transistor have equal drain-to-source voltages.

15. The reference voltage generating circuit of claim 1, wherein the voltage controlled voltage source circuit includes:

an amplifier including a positive input terminal, a negative input terminal, and an output terminal, wherein the positive input terminal is configured to receive the input voltage, the negative input terminal is configured to receive a feedback voltage, and the output terminal is configured to output an output voltage; and a reference voltage outputting circuit configured to generate the reference voltage and the feedback voltage according to the output voltage and a feedback ratio.

16. The reference voltage generating circuit of claim 15, wherein the feedback voltage is equal to the reference voltage multiplied by the feedback ratio.

17. The reference voltage generating circuit of claim 15, wherein the reference voltage outputting circuit includes:

an output transistor configured to be turned on or off according to the output voltage; and a feedback circuit configured to generate the reference voltage and the feedback voltage according to a conducting status of the output transistor and the feedback ratio.

18. The reference voltage generating circuit of claim 17, wherein the output transistor is coupled between a maximum operating voltage terminal and the feedback circuit; and the feedback circuit is coupled between the output transistor and a ground terminal.

19. The reference voltage generating circuit of claim 17, wherein the feedback circuit includes a first resistor and a second resistor; and a ratio of resistance of the first resistor to resistance of the second transistor determines the feedback ratio.

20. The reference voltage generating circuit of claim 19, wherein the first resistor and the second resistor are included in an adjustable resistance circuit.

* * * * *